US008146460B2

(12) United States Patent
Elliott

(10) Patent No.: US 8,146,460 B2
(45) Date of Patent: Apr. 3, 2012

(54) NAIL RIPPER

(75) Inventor: Craig Elliott, Ottawa (CA)

(73) Assignee: Craig Elliott Holdings Ltd., Ottawa, Ontario (CA)

( * ) Notice: Subject to any disclaimer, the term of this patent is extended or adjusted under 35 U.S.C. 154(b) by 281 days.

(21) Appl. No.: 12/480,762

(22) Filed: Jun. 9, 2009

(65) Prior Publication Data

US 2010/0307295 A1 Dec. 9, 2010

(51) Int. Cl.
*E04D 15/00* (2006.01)

(52) U.S. Cl. ..... 81/45; 254/21; 254/25

(58) Field of Classification Search ..... 81/45, 46; 299/36.1; D8/89; 254/18, 21, 25, 131
See application file for complete search history.

(56) References Cited

U.S. PATENT DOCUMENTS

| | | | | | |
|---|---|---|---|---|---|
| 949,337 | A | * | 2/1910 | Trogner | 254/25 |
| 1,218,145 | A | | 3/1917 | Whittier | |
| 1,515,009 | A | * | 11/1924 | Bump | 254/25 |
| 3,987,827 | A | * | 10/1976 | Mills | 81/45 |
| 4,182,390 | A | * | 1/1980 | Renner | 81/45 |
| 4,203,210 | A | | 5/1980 | Hadlick | |
| 4,466,188 | A | | 8/1984 | Svendsgaard | |
| 5,207,126 | A | * | 5/1993 | Schaben | 81/45 |
| 5,280,676 | A | | 1/1994 | Fieni | |
| D392,867 | S | | 3/1998 | Gracy et al. | |
| 5,836,222 | A | | 11/1998 | Harpell | |
| 6,029,545 | A | | 2/2000 | Harpell | |
| 6,098,292 | A | | 8/2000 | Harpell | |
| 6,125,720 | A | | 10/2000 | Gohman | |
| D439,126 | S | | 3/2001 | Gohman | |
| 6,339,975 | B1 | | 1/2002 | Harpell | |
| 2007/0051210 | A1 | | 3/2007 | Harpell | |

FOREIGN PATENT DOCUMENTS

| | | |
|---|---|---|
| CA | 2265084 | 9/1999 |
| CA | 2160399 | 7/2005 |
| CA | 2190549 | 7/2005 |
| CA | 2558934 | 3/2007 |
| CA | 2279113 | 10/2007 |

* cited by examiner

*Primary Examiner* — Debra S Meislin
(74) *Attorney, Agent, or Firm* — Blake, Cassels & Graydon LLP; Daphne L. Maravei

(57) ABSTRACT

The invention is a tool for lifting building materials, such as shingles, while extracting nails that fastened those materials. The slots that grip the nails are a concatenation of overlapping holes, for smooth insertion of the tool past the nails, and the envelope of the tool is a surface of curves for smooth insertion of the tool under the building materials. The bottom surface is a rocker that provides a moving fulcrum for prying out the nail, giving maximum force when the nail is first gripped and smoothly moving to maximum speed of extraction as the fulcrum moves back towards the user.

6 Claims, 5 Drawing Sheets

NAIL RIPPER

FIELD OF THE INVENTION

The invention relates to tools for removing material that has been nailed in place, such as asphalt shingles and roofing materials of all types, and flooring materials such as tile, carpet and wood strips. It is also useful in removing siding, panels, and moldings.

BACKGROUND TO THE INVENTION

When a building, or part of one, is to be taken apart, if material is to be salvaged, nails must be extracted. Some parts of buildings, notably roofing materials, are intended to be replaced many times in the life of the building. Roofing materials, such as shingles, are nailed in place, so removing the shingles for replacement requires extracting the nails. For efficiency, it is normal to lift the roofing material and the nail together, until the nail is fully extracted and the roofing material is detached from the building. The roofing material and the nail can then be discarded, and the wooden roof that has been exposed will be retained, possibly with some repairs, and covered with new roofing material.

This description will mainly speak in terms of lifting shingles, for brevity. That is an important use of the tool, but it must be remembered that the tool is useful for removing many types of building materials held by nails.

Most nails have heads that provide a grip for a pulling tool. Most pulling tools have a slot to grip the nail below the head, and operate as a lever with the fulcrum on the surface in which the nail is embedded, such as the roof. The common claw hammer is an example. Many more elaborate tools have been developed, and patented, but there remains room for improvement in respect of the smoothness of operation in guiding the tool around the nail, and in levering the nail out of the material in which it is embedded.

U.S. Pat. No. 1,218,145 to Whittier discloses, way back in 1917, a shingle stripper that is a blade having V-shaped slots on the front and back edges, and the bottom surface (and top surface, but that is irrelevant) having two dihedral planes creating a single ridge fulcrum where the two planes meet. The present invention improves on the shape of the slots, and provides a continuous fulcrum as a curved rocker.

U.S. Pat. No. 4,203,210 to Hadlick discloses a shingle stripper that is essentially a shovel with V-shaped slots at the front edge, and a separate fulcrum affixed at the rear edge. Again, the present invention improves on the shape of the slots, and provides a continuous fulcrum like a curved rocker.

U.S. Pat. Des. 392,687 to Gracy et al. discloses a multipurpose wrecking bar that has a flat bottom, so the only fulcrum is the rear edge. Gracy discloses slots with straight sides that taper either continuously, or in two different tapers, and some end the tapering straight side with a round hole.

U.S. Pat. No. 4,466,188 to Svendsgaard discloses a roofing remover that is wedge shaped and has slots that are straight parallel sides ending in a rounded end. The bottom surface is flat, but the tool as a whole is wedge shaped for forcing up the roofing material after the nail has been extracted. Extracting the nail involves lifting the nail by the slots, and the only fulcrum for lifting is the rear edge.

U.S. Pat. No. 5,280,676 to Fieni discloses an apparatus with slots having straight sides that taper in two different degrees, so the slot near the mouth of the slot converges rapidly and the remainder of the slot converges slowly or not at all. The bottom surface is almost all flat, but near the rear of the tool there is a bend that provides a ridge fulcrum before the rear edge comes into play as a fulcrum.

U.S. Pat. No. 6,125,720 to Gohman discloses a tool for removing roofing material that has slots much wider than a nail, and sub-slots within them that could seize a nail. All the slots have straight sides that taper narrower away from the leading edge. The blade is flat on the bottom (and top), but the manner of fastening it to the handle involves a curve that constitutes the rear edge for practical purposes. Most tools of this general type have the handle attached near the middle of the blade, but Gohman bends the blade and attaches the handle at the rear of the working surface of the blade. The bent rear edge of Gohman is not exactly a ridge fulcrum, but it is functionally different from the continuous curved rocker fulcrum of the present invention.

U.S. Design Pat. D439,126 to Gohman shows a thin blade with V-shaped teeth on the leading edge. The blade as a whole is partly flat and partly convex downward. It is quadrangular. The handle is attached at the rear of the blade, and the blade is not adaptable to have teeth on the rear edge. The prying force is delivered indirectly to the blade from the handle through an offset portion of the rear of the blade. As the blade has no reinforcing ribs or gussets, it is vulnerable to bending both along the main blade and in the offset joining the handle. This tool would require remarkably strong metal to operate with flexing.

U.S. Pat. No. 5,836,222 to Harpell discloses a shingle removing tool having slots with parallel sides, and an alternative with V-shaped slots. The bottom surface is flat, so the only fulcrum for lifting nails is the rear edge of the tool. The slots are simply parallel sides with rounded leading edges between them.

U.S. Pat. No. 6,029,545 to Harpell discloses a roofing tool having slots with parallel sides. The largest part of the bottom surface is flat, but blade is thinned near the leading edge so the bottom surface has a small portion near the leading edge that is a flat plane at a small angle to the rest of the bottom surface. Where the two planes meet, there is a ridge across the blade that serves as a fulcrum when the nail is first lifted. After a small advance of the nail, the fulcrum will shift to the rear edge of the blade, so this tool has two fulcrums, rather than the continuous rocker fulcrum of the present invention.

U.S. Pat. No. 6,098,292 to Harpell discloses a demolition tool having either no slots, or slots with parallel sides. The leading edge is designed for cutting, but cutting is often not desired, and rather grabbing and lifting is desired. It has a flat bottom, although with a groove, so its only fulcrum for leveraging nails upward is the rear edge. It has a quadrangular outline, which does not conform to a partially lifted shingle, and its sharp straight edges tend to cut the shingle, which is undesirable.

U.S. Pat. No. 6,339,975 to Harpell discloses long teeth on each side with straight sides, directing nails into slots that are rounded at the bottom and at the end of the finger between slots, but essentially have parallel sides. The bottom surface is flat, so the only fulcrum for lifting nails is the rear edge. The long fingers are very aggressive to the shingle, tending to cut, and pushing the long fingers much farther ahead than the slots where the nail will be lifted is inconvenient and hard work.

Published US application 20070051210 by Harpell discloses a tool blade with slots having two different degrees of taper near the mouth, and parallel sides to complete the slot. The bottom surface is two planes at a small dihedral angle, proving a fulcrum near the middle of the blade. There is also an alternative of a bottom surface that is flat through the middle majority of the surface, with a plane diverging at a small dihedral angle at each end. The present invention will improve on the design of the slots, and will provide a continuous fulcrum as a curved rocker. Harpell also provides an "impact receiving member" which is some distance up the handle above the blade. The present invention provides the equivalent hammer horns at a location that will better deliver the effect of impact to where it is helpful.

SUMMARY OF THE INVENTION

It is an object of the present invention to overcome the deficiencies noted in the prior art concerning tools for lifting building materials and associated nails. The invention guides itself around nails more smoothly than prior tools. The invention can be inserted under a shingle more smoothly because the envelope of its shape conforms to the shape that the shingle must take. The invention levers the nail more smoothly with a continuous rocking motion, starting with the most powerful prying force and smoothly advancing to the most rapid movement. In this summary, "smoothly" includes the meaning of easily, that is with less work, and it includes the meaning of proceeding without jerks and sudden stops, which is desirable for the comfort of the user.

All of the prior art uses nail gripping slots that do either little or nothing to guide the tool around the nail, or guide the nail with slanted straight edges that resist the movement of the tool. All of the prior art uses a small number of fulcrums, sometimes just the rear edge, and at other times an additional one, two, or three ridge fulcrums. The disadvantage of the rear edge fulcrum is that it is a long way from the nail to be lifted and the long lever arm gives poor leverage. The disadvantage of several added ridge fulcrums is that the shift from one to another as the extraction progresses causes a jerk in the movement of the handle which is tiresome to the user.

All of the prior art discloses essentially rectangular tools. The leading edge and the sides are straight, and typically at right angles. If their top is provided with two or more camming gussets to lift the shingles, they are the same height so the envelope of their lifting edges is planar. However, if the material being lifted is at all flexible, such as an asphalt shingle, the tool will be operating in a space under the lifted material that is semi-conical. The shingle is curved in all places where it is not contacting the roof. The lifted portion is like a bubble. When rectangular tools with straight edges are inserted into that bubble, they meet a lot of resistance and they do a lot of damage to the material being lifted. This is analogous to a square peg in a round hole. The lifting head of the present invention has an envelope that is curved, conforming to the curving bubble.

These and other objects, features, and characteristics of the present invention will be more apparent upon consideration of the following detailed description and appended claims with reference to the accompanying drawings.

BRIEF DESCRIPTION OF THE DRAWINGS

The preferred embodiments of the invention will now be described in detail with reference to the following drawings, in which.

DETAILED DESCRIPTION OF THE PREFERRED EMBODIMENT

Figure 1:
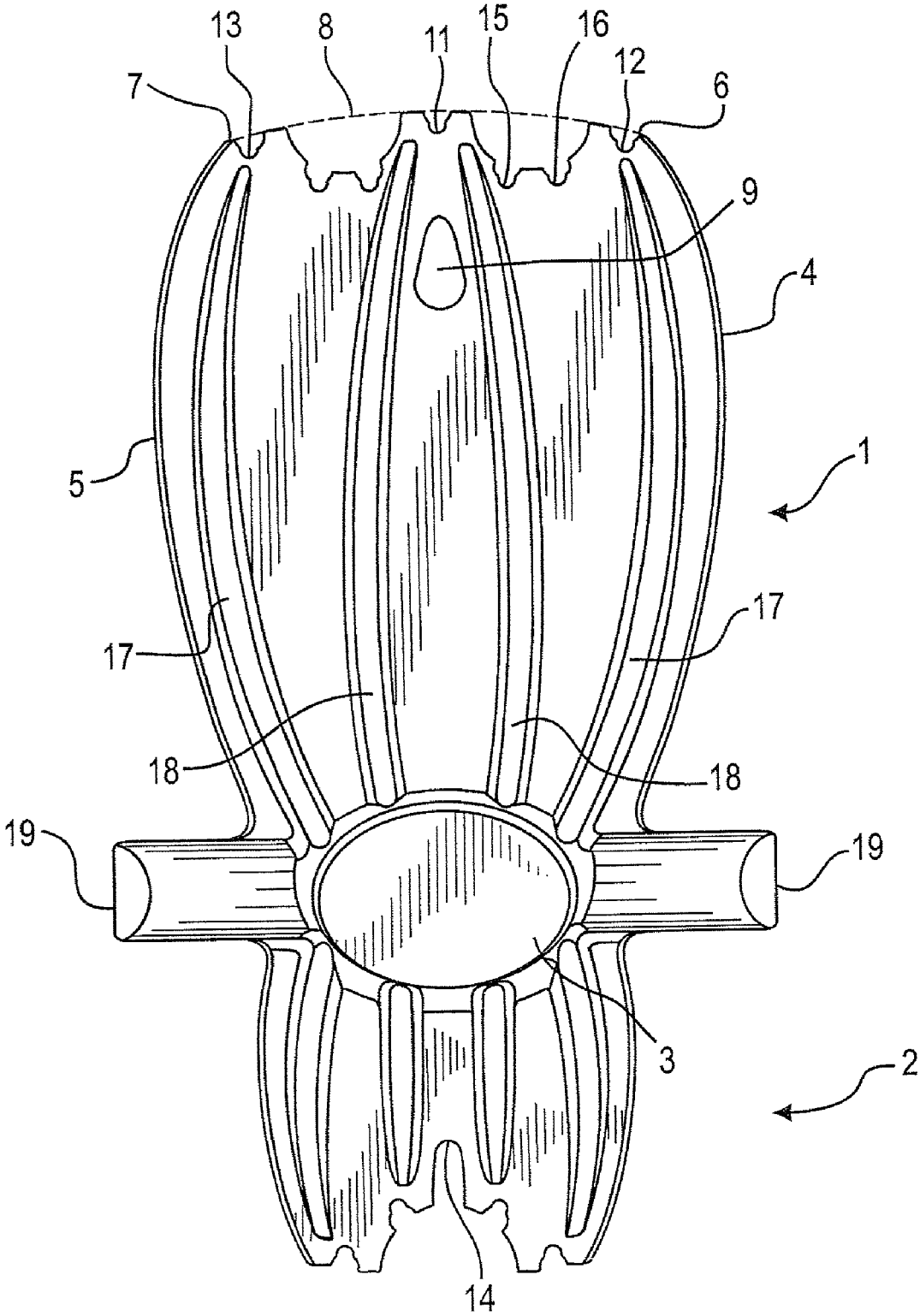
FIG. 1 shows the lifting head from above.

Referring to FIG. 1, the lifting head has a front portion 1 that is larger than the rear portion 2. The dividing line between front and rear passes through the handle mounting boss 3, which is adapted for mounting a handle that is inclined to the rear (downward in the drawing). Each of front portion 1 and rear portion 2 are symmetrical left and right about a line passing through the centre of the handle mounting boss 3.

The leading edge of the front portion 1 has slots in it, but if the slots are ignored for a moment, the imaginary envelope 8 of the leading edge is slightly curved so that side tips 6 and 7 are not as far forward as the leading edge between them. The sides 4 and 5 are slightly curved so that it is narrowest near the handle mounting boss 3, widest about two-thirds of the distance from the boss to the leading edge, and less wide at the leading edge.

The curved outline has beneficial effects. Until the last nail in a shingle is reached, the shingle under which the leading edge is slipped will be held close to the roof by one or more nails on at least one side of the lifting head. When the lifting head grips a nail and raises the nail and the shingle together, the shingle will bend down on the side where there is another nail, and in the direction ahead of the tool. The shingle will tend to a semi-conical shape, curved with its highest point at the centre line of the lifting head. The curved front and sides of the lifting head are a better fit to the curving bottom surface of the lifted shingle than straight sides would be. If the leading edge were straight, the lifted shingle would have to lift equally across the width of the lifting head and then fall away at the sides. Such a design tends to encourage breaking of the shingle, which is less efficient because a smaller section is lifted and more broken sections of shingles remain to be dealt with individually. Straight sides and a straight leading edge would tend to cut into and break the shingles more than the curved sides and curved leading edge.

The entire front portion 1 of the lifting head can be imagined surrounded by an envelope which bridges over slots and ridges and is the smooth surface that would neatly encase the lifting head. An aspect of the invention is that such an envelope would have nothing but curved surfaces when viewed from any perspective. There are no straight lines in the envelope, except perhaps the small vertical sidewall that is the thickness of the blade.

Sides 4 and 5 curve outward as they leave side tips 6 and 7 for the reasons just discussed, but after some distance sides 4 and 5 continue curving so that the lifting head becomes narrower near the handle mounting boss 3 than at the leading edge. That narrowing reduces weight and cost, but it is not an essential feature. The narrowing near the mounting boss 3 also allows the hammer horns to project beyond the lifting head and so be more exposed for the purpose of being struck, without being long. A long hammer horn would have the disadvantage that blows on it tend to rotate the lifting head, which is unhelpful. The hammer horns are preferably located as close to the centreline as possible, because that maximizes the transfer of the force of a blow to the leading edge of the lifting head. In some tools known in the prior art, an element intended to receive blows is placed on the hosel or the handle, but that has the disadvantage that the force of the blow is partly dissipated by the resilience of the handle, and also the force has a vertical component that is wasted, and counter-productive, for the purpose of forcing the tool to lift nails and shingles.

The leading edge of the front portion 1 has a number of slots, into which nails will slide when the lifting head is pushed forward. All slots are formed from overlapping round holes. In other words, the sides of slots are all arcs of several circles that overlap, so no circle is complete. In principle, the slots could be formed by drilling a number of round holes, but that is not the practical way to produce the slots. In the embodiment shown, the central slot 11 and the two outer slots 12 and 13 are suitably formed from two overlapping holes, with the outer hole about 3 times the diameter of the inner one. The slots 15, 16 midway between the centre and the sides are each suitably formed with a pair of inner holes, plus a pair of holes overlapping those inner holes and about three times the diameter of the inner holes, and finally a pair of still larger holes, overlapping the last-mentioned holes and overlapping each other. The use of round holes means that the sides of the slots are a series of arcs. Arcs are well suited for guiding the lifting head past the nail shaft until the end of the slot is reached, or until the slot is smaller than the nail shaft diameter. The nail shaft will be cupped by the arcuate side of the slot, and the head of the nail will extend over the top surface of the lifting head so that when the leading edge of the lifting head rises, the nail is pulled and the shingle is lifted.

Figure 2:
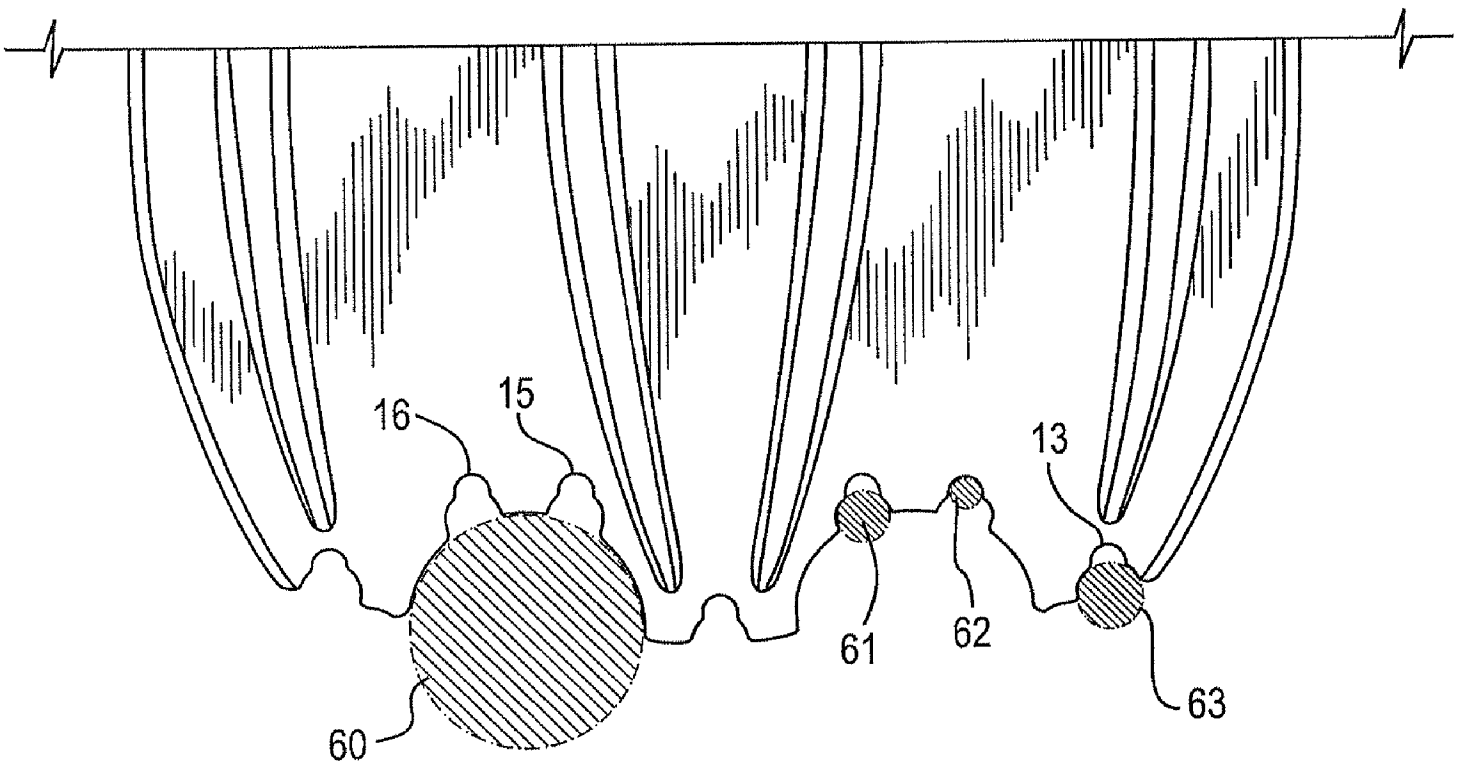
FIG. 2 shows the design of slots, made of overlapping holes.

FIG. 2 shows the circular nature of the sides of the slots. Circle 60 defines the arcs that are part of the outermost portion of a slot. Circle 61 defines the next portion of a slot, and circle 62 defines the smallest portion and end of a slot. Circles 61 and 62 are shown in separate slots, not overlapping circle 60, but the shape of slots 15 and 16 is the same as a circle like 62 innermost overlapped by a circle like 61 next outwards, and circle 60 overlapping circle 62 in each of slots 15 and 16. Circle 63, defining part of slot 13, would typically be about the same size as circle 61, but the exact size of any circle, and so of any slot, is not critical to the invention.

It is common in the prior art to use converging sides of the slots, and when the nail reaches the slot width equal to the shaft diameter, the tool often goes a little farther and bites into the nail. That is undesirable because the nail clings to the tool, and may be cut right through or is at least easily broken where the bite occurred. Straight sides of a slot bite into the nail because they are tangent to the nail surface, and the point of contact is small so the force is concentrated. In the present invention the sides of the slot are not a straight tangent to the nail but approximately concentric with the nail. The contact is not at a point, but along a short arc, so the force is not concentrated at a point and the edge is less likely to bite into the nail.

Other known nail extracting tools of the pry-bar type usually have either slots with converging sides, as with the classic claw hammer, or slots with a change of angle along the sides so the leading portion of the slot is wider than the following portion. A common example of the latter type is a series of slots defined by a series of fingers having leading ends that taper to narrowness at the leading edge, which may be a rounded leading edge of each finger. A tool with multiple slots must have the slots spaced sufficiently apart that the fingers between them have enough material to be strong, keeping in mind that the material is necessarily thin since it must slip under the head of the nail. The tool will more readily slide around the shaft of the nail if the slot has a wide opening to find the nail and guide the tool around the shaft.

Figure 3A:
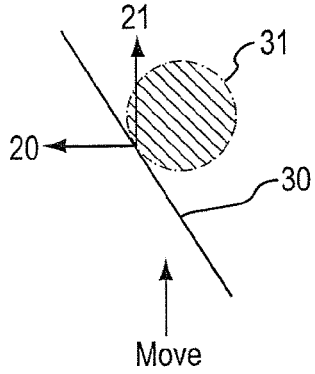
FIG. 3*a* shows the forces at work in guiding the lifting head around a nail in the prior art.
Figure 3B:
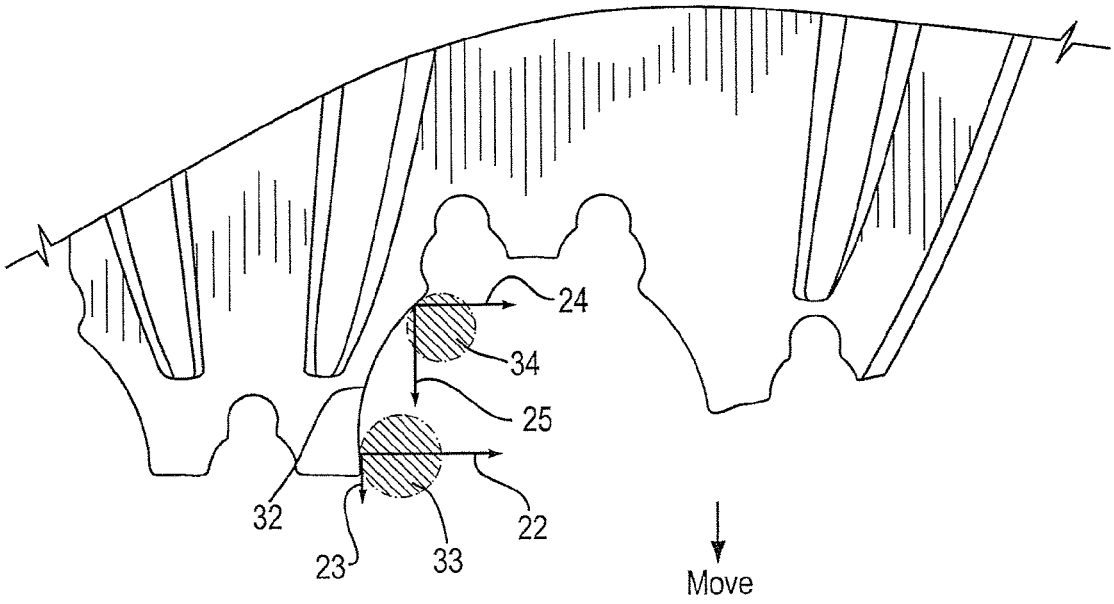
FIG. 3*b* shows those forces as the operate in the present invention.

FIG. 3*a* and FIG. 3*b* illustrate the benefit of slots made of overlapping round holes. FIG. 3*a* shows the prior art, where the side of the slot 30 is straight but inclined to the direction of motion of the tool, which is vertically upward in the drawing. The force moving the lifting head forward will resolve into a vector 20 moving the tool to the left by pushing on the nail 31, and vector 21 pushing against the nail. A force equal to vector 21 is felt by the user, as the nail 31 pushes back on the tool 30. Both vectors 20 and 21 are constant from the moment of first contact of the lifting head with the nail. The forward vector 21 is pushing strongly against the nail 31, which has the disadvantage of possibly digging into the nail or even cutting through it. Another disadvantage is that the emergence of two vectors happens instantly upon contact with the nail and the user must instantly supply the extra force for vector 21, which means that the user feels a large shock force upon encountering the nail.

FIG. 3*b* shows an aspect of the present invention, where the sideways vector 22 is very small at the moment of first contact, and so is the forward vector 23. The side of the lifting head surface 32 is sliding almost tangentially against the nail 33, with little resistance. The user feels almost no shock force and the forward vector 23 is almost undiminished as the tool continues to advance smoothly. As the nail moves along the curve and takes the position of nail 34, the sideways vector 24 grows and the sideways movement accelerates. There is little or no shock force felt by the user, because vector 25 increases gradually. Of course, there is a shock when the nail 34 settles at the end of the slot and movement stops, but by that time the various sources of friction, namely the lifting head sliding over the roof and under the shingle and against the nail, have gradually lowered the speed of the tool and the shock of stopping when the nail reaches the end is not large.

Although the holes have been described as round, which is a shape easily made, the invention would also achieve the intended benefits if the holes were to have some ellipticity.

The slots in the lifting head will lift nails in a wide range of sizes. The fingers that define the slots will lift staples.

FIG. 1 shows that the top surface of the lifting head has a number of ridges 17, 18. As with all aspects of the lifting head, the ridges are symmetrical about the centre line passing through the handle mounting boss 3 and midway between the side tips 6, 7. These ridges not only strengthen the lifting head for its nail-pulling purpose, but lift the shingle from the roof and begin to direct it upwards sliding over the handle, in a camming manner.

On each side of the lifting head, on a line passing through the handle mounting position, there is a horn 19 that projects to a distance a little greater than the maximum width of the lifting head. This is useful for striking with a hammer, or kicking, to force the lifting head under particularly resistant shingles. The horns 19 curve up away from the surface on which the lifting head is resting, so that the lifting head can be rocked sideways as part of the nail extraction without a horn 19 becoming a fulcrum.

FIG. 1 shows that the rear portion 2 resembles the front portion 1, but is smaller. The sides, and the envelope of the leading edge, of the rear portion 2 are curved for the same reason as in the front portion 1. The construction with ridges is similar. The slots are made of overlapping round holes, with one exception that is optional. The central slot 14 is large enough for a large nail or spike, such as may be encountered sometimes in the course of removing shingles or flooring or siding or any material that was generally attached with smaller nails for which this lifting head as a whole is adapted. Such large nails usually require a claw hammer or pry bar, but if this tool is at hand, slot 14 is convenient for occasional use.

Another optional feature in FIG. 1 is a hole 9 that has a large end and a small end. The head of a nail will pass through the large end, and the tool can then be pulled so the shaft of the nail is passing through the small end. When the tool is rocked or lifted the small end will press on the head of the nail and extract the nail. This is especially useful for large nails that are occasionally encountered, or particularly stubborn nails that would rather bend than move when pried on by the slots at the leading edge of the lifting head.

Figure 4:
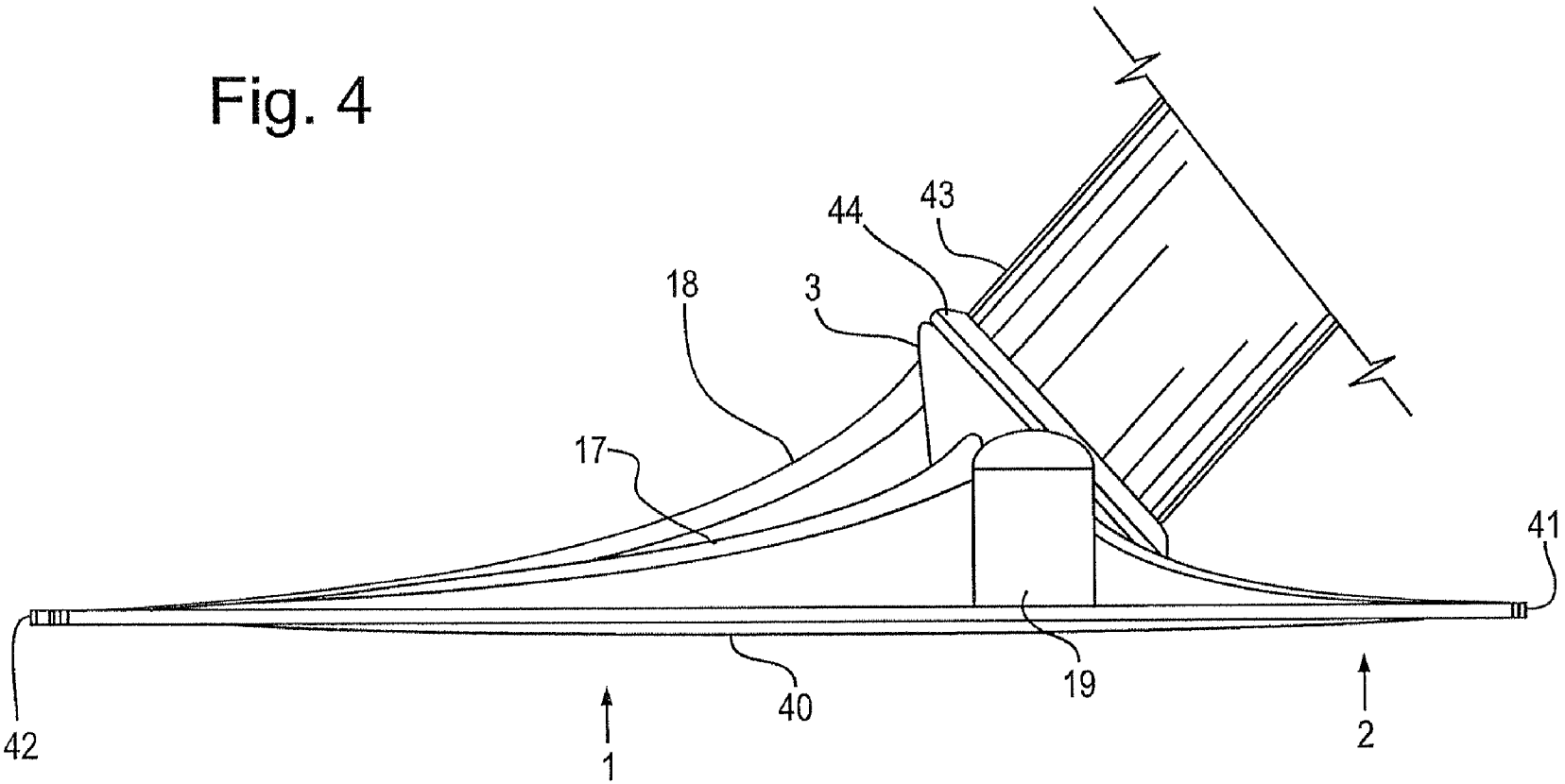
FIG. 4 shows a side view of the lifting head.

FIG. 4 shows another important aspect of the invention, the convexity of the bottom surface 40. The bottom surface of the lifting head is a section of a cylinder. It may be an elliptical cylinder. The radius of curvature may be the same for the entire bottom surface of combined front portion 1 and rear portion 2, as illustrated, or may change at some point, most likely below the handle mounting position, so that there is a smaller radius of curvature in the rear portion 2. In that case, the bottom surface would be sections of two cylinders. The leading edge 42 and the rear edge 41 must be thin enough to reach under a nail head while slightly compressing a shingle through which the nail passes. The thinness is achieved by the convergence of the semi-cylindrical bottom surface 40 with the top surface, and the top surface may optionally be thinned as it approaches the leading edge 42 and rear edge 41.

As the lifting head is rocked to the rear, the bottom surface will be in constant tangential contact with the roof. The point of contact with the roof, the fulcrum, will shift on the roof in the direction towards the rear edge 41 of the lifting head, as the front end 42 rises and brings with it a nail and a shingle. It is advantageous to make such rocking contact, rather than, as in the prior art, having a sharp ridge where two planes of the bottom surface meet at a small dihedral angle. A ridge can dig into the roof surface and cause damage, whereas the convex rocking surface causes no damage. Another advantage is that the rocking motion is smooth through a large angle of the handle, until the point of contact (the fulcrum) reaches the rear edge 41 of the lifting head. In practice, it is often not necessary for the fulcrum to reach the rear edge 41, as the shingles and nails have been pried from the roof before then. In contrast, the prior art has two types of bottom surfaces—either flat all over, or several flat planes. The fully flat prior tools use the rear edge as the fulcrum for leverage. The multi-plane prior tools use a transverse ridge as a first fulcrum, and then come to another intersecting plane so that the leverage abruptly shifts to the rear edge as the second fulcrum. Some versions have two fulcrum ridges before reaching the rear edge as a fulcrum. The shift of fulcrums subjects the user to an uncomfortable and tiring jerk in every removal. In other words, the prior art for roofing tools has either one fulcrum, that being the rear edge, or two fulcrums, being a ridge near the middle and the rear edge, or rarely three fulcrums of which the last is the rear edge. The convex surface of the present invention has an infinite number of fulcrums. The convex surface is functionally similar to the curved side of a claw hammer, which invariably is a curve not a plane, perhaps with changing curvature but without a ridge where there is a dihedral angle between planes.

FIG. 4 also shows features discussed in connection with FIG. 1, a couple of ridges 17, 18, and one of the horns 19 projecting out of the page. The ridge 18, which is closer to the centre line than ridge 17, is higher than ridge 17. This is an aspect of the overall roundedness of the lifting head. The shingle that is being lifted will usually be attached to the roof in at least the forward direction and one side direction. When it is lifted, the shingle curves down in all directions from the lift point, which is on the centreline of the lifting head. The shingle could be described as having a bubble formed in it. The lifting head disclosed here conforms approximately to the bubble shape, which has the beneficial effect or reduced resistance to advancing the bubble, and less cutting and breaking of the shingle.

The top surface of each of the ridges 17, 18 is preferably concave upwards, to cammingly move the shingles upwards. It is known in the prior art to have one or two camming elements, which may or may not also serve as strengthening gussets, but a larger number, at least 4, of camming elements provides better lifting and dispersal of the shingles. A single gusset tends to slice the shingles without forcing them upwards, so then the leading edge of the shingles strikes the hosel and stalls progress. A triangular gusset would have a greater tendency than a curved ridge to slice the shingles, because the curved arc makes a gradual attack on the shingle, and benefits further from having a rounded top of the ridge all along the ridge.

FIG. 4 shows a handle 43 attached to the handle mounting boss 3. The lifting head is most effectively manufactured by hot forging, although the invention is not limited to forged heads. Forging cannot produce a hole suitable for a handle, so a metal handle would typically be attached by a weld 44 to the lifting head. Alternatively a metal hosel could be attached to the handle mounting boss 3 by a weld 44, and the hosel would stand in the position 43 in the figure. The hosel could be fitted with a handle of wood, fibreglass, or any material suitable for a tool handle.

Forging is not well suited to producing thin portions of the forged article, as required at the leading edge and typically at the rear edge of the lifting head. To obtain the desired thinness of the leading and rear edges, it is generally desirable to finish the bottom surface with a grinding operation. Grinding is well suited to producing a slightly convex surface, tapering to a thin edge comparable to the edge of a dull knife. The slots, in the pattern of a series of overlapping round holes, and any complete holes, will typically be formed by a hot trimming press while the lifting head is still ductile and softened from the hot forging process.

Figure 5:
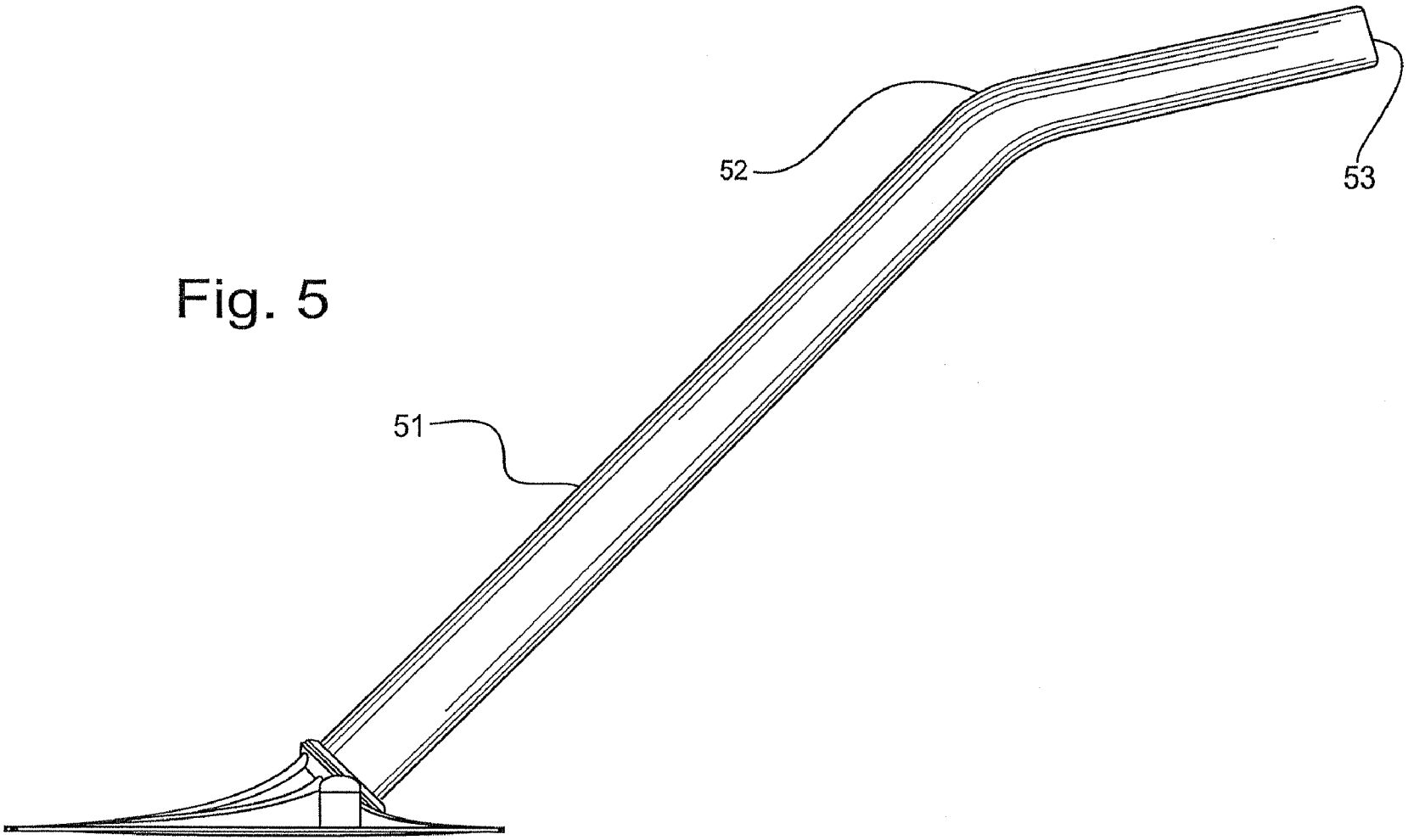
FIG. 5 shows a side view of the whole tool, comprising the handle and the lifting head.

FIG. 5 shows the tool with a handle 51. The handle 51, if it is metal, will be welded to the handle mounting boss 3. Alternatively, if the handle mounting boss 3 is fitted with a hosel (not shown) that is a few inches long, a handle can be inserted in the hosel. Such a handle may be made of wood, fibreglass, steel, or any material known to be suitable for tool handles. The preferred shape of the handle has a bend 52 at about two-thirds of the distance towards the end 53. That ensures that the end 53 of the handle will touch the roof, in an extreme prying operation, before the user's hand which is near the bend 52 would touch the roof, thus protecting the hand.

Many modifications and variations besides those mentioned herein may be made in the techniques and structures described and depicted herein, resulting in other embodiments of the present invention without departing from the concept of the present invention. The foregoing disclosures should not be construed in any limited sense other than the limits of the claims that follow. Thus the scope of the invention should be determined by the appended claims and their legal equivalents rather than by the examples given.

What is claimed is:

1. A tool for lifting building materials while pulling nails, comprising a blade having a front edge, a rear edge, two side edges, an upper surface, and a bottom surface, said bottom surface being semi-cylindrically convex as viewed looking at said tool edge-on towards either of said side edges;

a boss on said upper surface for attaching a handle, said boss being closer to said rear edge than to said front edge;

said side edges in the region of said blade between said boss and said front edge being convex;

said front edge being convex and indented by a plurality of slots each having a closed end and an open mouth;

each of said slots having slot edges comprising arcs of progressively larger overlapping circles sized from smallest to largest, the smallest of said circles being at the closed end of said slots and the circles progress in size in the direction of said front edge until the largest of said circles overlaps said front edge to define the open mouth of said slots.

2. The tool of claim 1, further comprising said side edges in the region of said blade between said boss and said rear edge being convex;

said rear edge being convex and indented by a plurality of slots each having a closed end and an open mouth;

each of said slots having slot edges comprising arcs of progressively larger overlapping circles sized from smallest to largest, the smallest of said circles being at the closed end of said slots and the circles progress in size in the direction of said rear edge until the largest of said circles overlaps said rear edge to define the open mouth of said slots.

3. The tool of claim 1 further comprising one or more impact receiving members extending outwards from said boss.

4. The tool of claim 1 further comprising one or more slots having two parallel sides.

5. The tool of claim 1 further comprising a plurality of ridges on said upper surface running from near said boss towards said front edge, each of said ridges being concave with vanishing height near said front edge and its greatest height near said boss, with the height of said ridges near said boss being greatest for ridges that are farthest from said side edges.

6. The tool of claim 2 further comprising a plurality of ridges on said upper surface running from near said boss towards said rear edge, each of said ridges being concave with vanishing height near said rear edge and its greatest height near said boss, with the height of said ridges near said boss being greatest for ridges that are farthest from said side edges.

* * * * *